US008091313B2

(12) United States Patent
Wilson et al.

(10) Patent No.: US 8,091,313 B2
(45) Date of Patent: Jan. 10, 2012

(54) DRAINAGE PLACE FOR EXTERIOR WALL PRODUCT

(75) Inventors: Richard C. Wilson, Traverse City, MI (US); Patrick M. Culpepper, Massillon, OH (US)

(73) Assignee: Progressive Foam Technologies, Inc., Beach City, OH (US)

( * ) Notice: Subject to any disclaimer, the term of this patent is extended or adjusted under 35 U.S.C. 154(b) by 422 days.

(21) Appl. No.: 10/965,538

(22) Filed: Oct. 14, 2004

(65) Prior Publication Data

US 2005/0081468 A1 Apr. 21, 2005

Related U.S. Application Data

(60) Provisional application No. 60/511,527, filed on Oct. 15, 2003.

(51) Int. Cl.
*E04D 3/40* (2006.01)
*E04D 13/16* (2006.01)

(52) U.S. Cl. ..... 52/534; 52/520; 52/302.1; 52/302.3

(58) Field of Classification Search ..... 52/302.3, 52/533, 302.1, 519, 520, 534, 543, 556, 545
See application file for complete search history.

(56) References Cited

U.S. PATENT DOCUMENTS

| | | | | | |
|---|---|---|---|---|---|
| 1,776,116 | A | * | 9/1930 | Harvey | 29/527.4 |
| 1,882,529 | A | * | 10/1932 | Thulin | 52/440 |
| 1,976,166 | A | * | 10/1934 | Fricdberg | 52/302.6 |
| 1,998,425 | A | * | 4/1935 | McNeil | 52/145 |
| 2,264,961 | A | * | 12/1941 | Ward | 52/302.3 |
| 3,001,332 | A | * | 9/1961 | Wilder | 52/302.1 |
| 3,124,427 | A | * | 3/1964 | Chomes | 428/603 |
| 3,158,960 | A | | 12/1964 | Newton | |
| 3,159,943 | A | | 12/1964 | Sugar | |
| 3,283,460 | A | * | 11/1966 | Patrick | 52/274 |
| 3,284,980 | A | | 11/1966 | Dinkel | |
| 3,289,371 | A | | 12/1966 | Pearson et al. | |
| 3,304,678 | A | | 2/1967 | Morell | |
| 3,308,586 | A | | 3/1967 | Olson | |
| 3,608,261 | A | | 9/1971 | French et al. | |
| 3,742,668 | A | | 7/1973 | Oliver | |
| 3,826,054 | A | | 7/1974 | Culpepper, Jr. | |
| 3,868,300 | A | | 2/1975 | Wheeler | |
| 3,887,410 | A | | 6/1975 | Lindner | |
| 3,941,632 | A | | 3/1976 | Swedenberg et al. | |
| 3,944,698 | A | | 3/1976 | Dierks et al. | |
| 3,993,822 | A | | 11/1976 | Knauf et al. | |
| 3,998,021 | A | | 12/1976 | Lewis | |
| 4,015,391 | A | | 4/1977 | Epstein et al. | |
| 4,033,702 | A | * | 7/1977 | Moerk, Jr. | 404/69 |
| 4,033,802 | A | | 7/1977 | Culpepper, Jr. et al. | |
| 4,034,528 | A | | 7/1977 | Sanders et al. | |
| 4,065,333 | A | | 12/1977 | Lawlis et al. | |

(Continued)

FOREIGN PATENT DOCUMENTS

| | | |
|---|---|---|
| CA | 721719 | 11/1965 |

(Continued)

*Primary Examiner* — Phi Dieu Tran A
(74) *Attorney, Agent, or Firm* — Fay Sharpe LLP; Richard M. Klein

(57) ABSTRACT

An apparatus and method for a drainage system of an exterior wall of a building comprising insulation having a rear face for contact with the exterior wall of the building and a drainage plane positioned on the rear face for removal of water from the exterior wall.

12 Claims, 4 Drawing Sheets

U.S. PATENT DOCUMENTS 4,073,997 A 2/1978 Richards et al.
4,081,939 A 4/1978 Culpepper, Jr. et al.
4,096,011 A 6/1978 Sanders et al.
4,098,044 A * 7/1978 Slavik ..... 52/302.1
4,100,711 A 7/1978 Skuran
4,181,767 A 1/1980 Steinau
4,188,762 A 2/1980 Tellman
4,242,406 A 12/1980 El Bouhnini et al.
4,244,761 A * 1/1981 Remi et al. ..... 156/71
4,277,526 A 7/1981 Jackson
4,288,959 A 9/1981 Murdock
4,296,169 A 10/1981 Shannon
4,303,722 A 12/1981 Pilgrim
4,318,258 A * 3/1982 Heck ..... 52/309.12
4,335,177 A 6/1982 Takeuchi
4,351,867 A 9/1982 Mulvey et al.
4,361,616 A 11/1982 Bomers
4,366,197 A 12/1982 Hanlon et al.
4,369,610 A * 1/1983 Volan ..... 52/509
4,399,643 A 8/1983 Hafner
4,437,274 A 3/1984 Slocum et al.
4,468,909 A 9/1984 Eaton
4,477,300 A 10/1984 Pilgrim
4,504,533 A 3/1985 Altenhofer et al.
4,506,486 A 3/1985 Culpepper, Jr. et al.
4,586,304 A * 5/1986 Flamand ..... 52/309.8
4,637,860 A 1/1987 Harper et al.
4,639,165 A * 1/1987 Flecknoe-Brown ..... 405/45
4,647,496 A 3/1987 Lehnert et al.
4,686,803 A * 8/1987 Couderc et al. ..... 52/97
4,722,866 A 2/1988 Wilson et al.
4,745,716 A * 5/1988 Kuypers ..... 52/169.5
4,810,569 A 3/1989 Lehnert et al.
4,864,788 A 9/1989 Tippmann
5,056,281 A * 10/1991 McCarthy ..... 52/169.5
5,220,762 A 6/1993 Lehnert et al.
5,319,900 A 6/1994 Lehnert et al.
5,371,989 A 12/1994 Lehnert et al.
5,443,878 A * 8/1995 Treloar et al. ..... 428/60
5,501,056 A 3/1996 Hannah et al.
5,502,940 A * 4/1996 Fifield ..... 52/309.12
5,511,346 A * 4/1996 Kenworthy ..... 52/169.5
5,542,222 A 8/1996 Wilson et al.
5,598,677 A 2/1997 Rehm, III
5,601,888 A 2/1997 Fowler
5,615,525 A * 4/1997 Kenworthy ..... 52/169.5
5,636,489 A 6/1997 Leverrier et al.
5,644,880 A 7/1997 Lehnert et al.
5,704,172 A * 1/1998 Gougeon et al. ..... 52/169.11
5,704,179 A 1/1998 Lehnert et al.
5,772,846 A 6/1998 Jaffee
5,791,109 A 8/1998 Lehnert et al.
5,799,446 A 9/1998 Tamlyn
D402,770 S 12/1998 Hendrickson et al.
5,881,502 A 3/1999 Tamlyn
5,930,960 A * 8/1999 Konnerth ..... 52/169.5
5,945,182 A 8/1999 Fowler et al.
5,960,598 A 10/1999 Tamlyn
5,981,406 A 11/1999 Randall
6,018,924 A 2/2000 Tamlyn
6,029,415 A 2/2000 Culpepper et al.
6,195,952 B1 3/2001 Culpepper et al.
6,247,874 B1 * 6/2001 Hu ..... 405/43
6,263,574 B1 7/2001 Lubker, II et al.
6,276,107 B1 8/2001 Waggoner et al.
D448,865 S 10/2001 Manning
D450,138 S 11/2001 Barber
6,321,500 B1 11/2001 Manning et al.
6,337,138 B1 1/2002 Zehner et al.
6,341,458 B1 1/2002 Burt
6,345,479 B1 2/2002 Hutchison et al.
6,354,049 B1 3/2002 Bennett
6,358,585 B1 3/2002 Wolff
6,360,508 B1 3/2002 Pelfrey et al.
6,367,222 B1 4/2002 Timbrel et al.
6,393,785 B1 5/2002 Burt
6,409,952 B1 6/2002 Hacker et al.
6,418,610 B2 7/2002 Lubker et al.
6,453,630 B1 9/2002 Buhrts
6,464,913 B1 10/2002 Korney, Jr.
D471,292 S 3/2003 Barber
6,526,718 B2 3/2003 Manning et al.
6,684,597 B1 2/2004 Butcher
6,691,472 B2 * 2/2004 Hubert ..... 52/169.5
6,792,725 B1 * 9/2004 Rutherford ..... 52/209
6,990,775 B2 * 1/2006 Koester ..... 52/302.1
7,040,067 B2 5/2006 Mowery et al.
7,059,087 B2 * 6/2006 Allen ..... 52/58
7,117,651 B2 * 10/2006 Beck ..... 52/553
7,181,888 B1 * 2/2007 Facaros ..... 52/169.5
2002/0029537 A1 3/2002 Manning et al.
2003/0029097 A1 2/2003 Albracht
2003/0056458 A1 * 3/2003 Black et al. ..... 52/541
2006/0042183 A1 3/2006 Benes
2006/0053715 A1 3/2006 Mowery et al.
2006/0068188 A1 9/2006 Morse et al.
2007/0044402 A1 3/2007 Hess

FOREIGN PATENT DOCUMENTS

CA 794590 9/1968
DE 2808723 A1 3/1979
EP 0148761 A2 7/1985
JP 2141484 A2 5/1990
JP 04189938 6/1992
JP 5147997 A2 6/1993
JP 6008219 A2 1/1994
WO 9957392 A1 11/1999
WO 02070248 A1 9/2002
WO 02081399 A1 10/2002

* cited by examiner

DRAINAGE PLACE FOR EXTERIOR WALL PRODUCT

CROSS-REFERENCE TO RELATED APPLICATIONS

This application claims the benefit of provisional patent application Ser. No. 60/511,527 filed on Oct. 15, 2003, which is incorporated by reference herein in its entirety.

FIELD OF THE INVENTION

The present invention relates to a siding panel for an exterior wall of a building. In particular, the invention provides for a drainage plane positioned on the rear face of a contoured foam backer used with siding products. The drainage plane allows water to more efficiently dissipate from the exterior wall.

BACKGROUND OF THE INVENTION

The construction industry, both new construction and remodeling, is increasingly confronted with problems associated with the buildup of moisture on surfaces within exterior walls. This moisture buildup may cause various types of mold, including black mold. Such mold is frequently blamed for causing serious respiratory illnesses and numerous other health conditions in both humans and animals. Individuals often go to great expense to remove mold from their homes, and in extreme cases walls and even entire structures are torn down.

Building codes have long required that exterior walls be permeable so that moisture can escape if such moisture finds its way into the wall. However, on occasion due to poor insulation, inadequate flashing, leaking pipes or bad building practices, water can nonetheless find its way into exterior walls. In some cases water can be found in such large quantities that it overwhelms the exterior wall system. In other words, the exterior wall material simply cannot dissipate the moisture fast enough before conditions become sufficient to promote the growth of mold.

A need has arisen to improve dissipation of water in the exterior walls of buildings.

SUMMARY OF THE INVENTION

The present invention is intended to augment exterior wall systems to assist in the removal of water or water vapor from such exterior walls. Exterior walls often include insulation products, for example, contoured foam backing or composite siding. Exterior insulation includes a rear face that contacts the building. The present invention provides a drainage plane on that rear face to facilitate the removal of water from the exterior wall. The drainage plane can be made up of a grid of grooves that provide a path for water to flow. These grooves encourage water from leaks and water from heavy condensation to run theredown off the exterior wall and away from the building. In the preferred embodiment, and when used with composite siding, the water flows out through weep holes located in the bottom of the siding. It is understood that the grooves may be positioned in any number of ways, including vertically or diagonally.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENTS

The present invention relates to a drainage arrangement positioned on a rear face of an exterior insulation product. The construction market utilizes a large number of exterior insulation products. The preferred embodiment of the instant application is described in the context of composite siding by example only. It is understood that the instant invention could be applied to any exterior insulation product having a planar surface.

The drainage arrangement, as it is positioned on the otherwise flat rear face of a foam backer, is generally referred to as a drainage plane. The drainage plane is configured to encourage water from leaks and water from heavy condensation to run down grooves positioned therein. The grooves can be of any of a wide variety of configurations and can be laid out in any of a wide variety of patterns. The grooves can be positioned in a grid and can be positioned anywhere from vertically to some angle off the vertical. The drainage plane of the present invention is particularly beneficial in those cases where a foam board is positioned flat against another component such as an OSB panel that would naturally resist the water from freely running down the back of the OSB panel.

Figure 1:
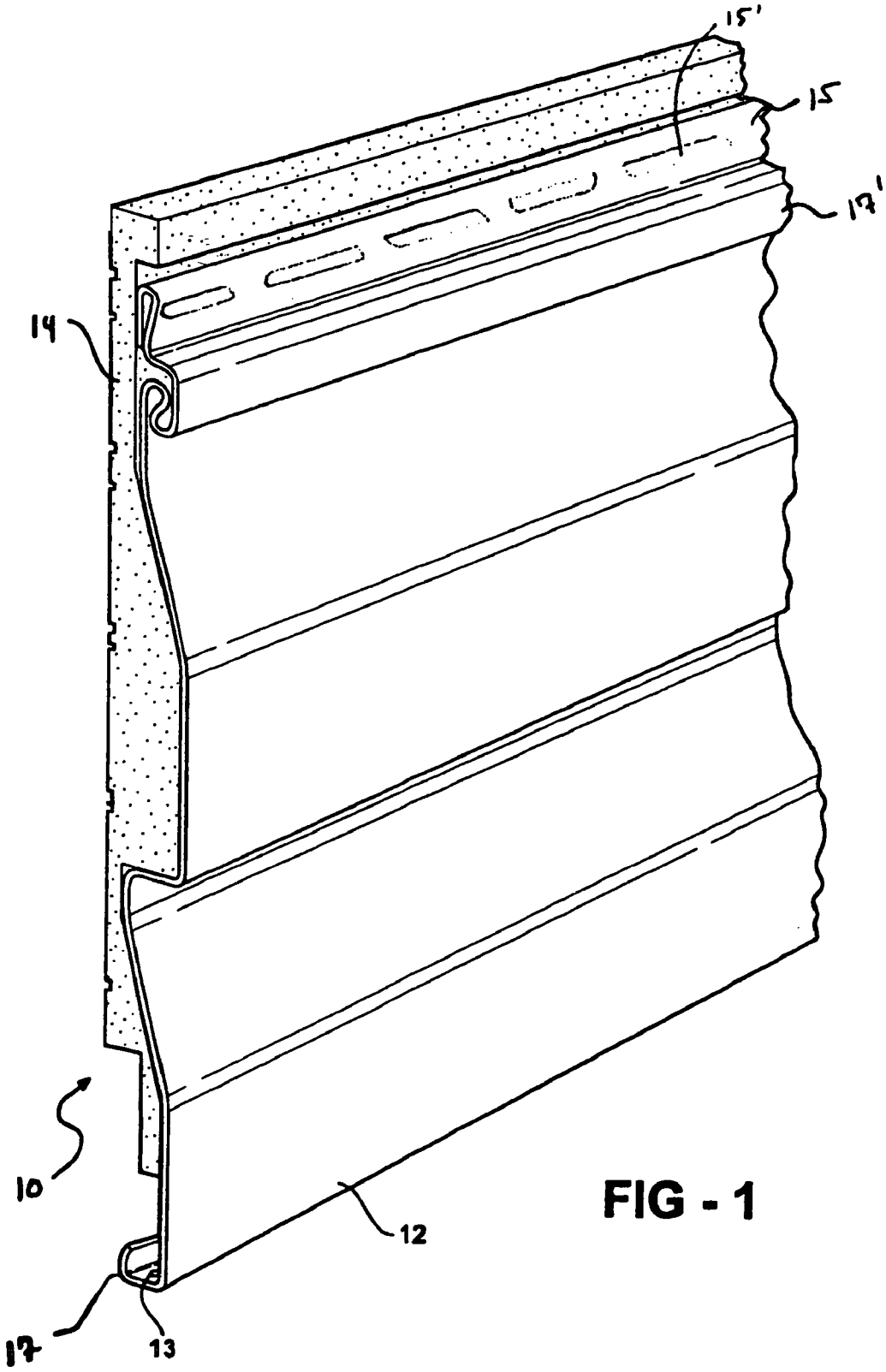
FIG. 1 is a front perspective view of a composite siding panel including the drainage plane of the present invention.
Figure 2:
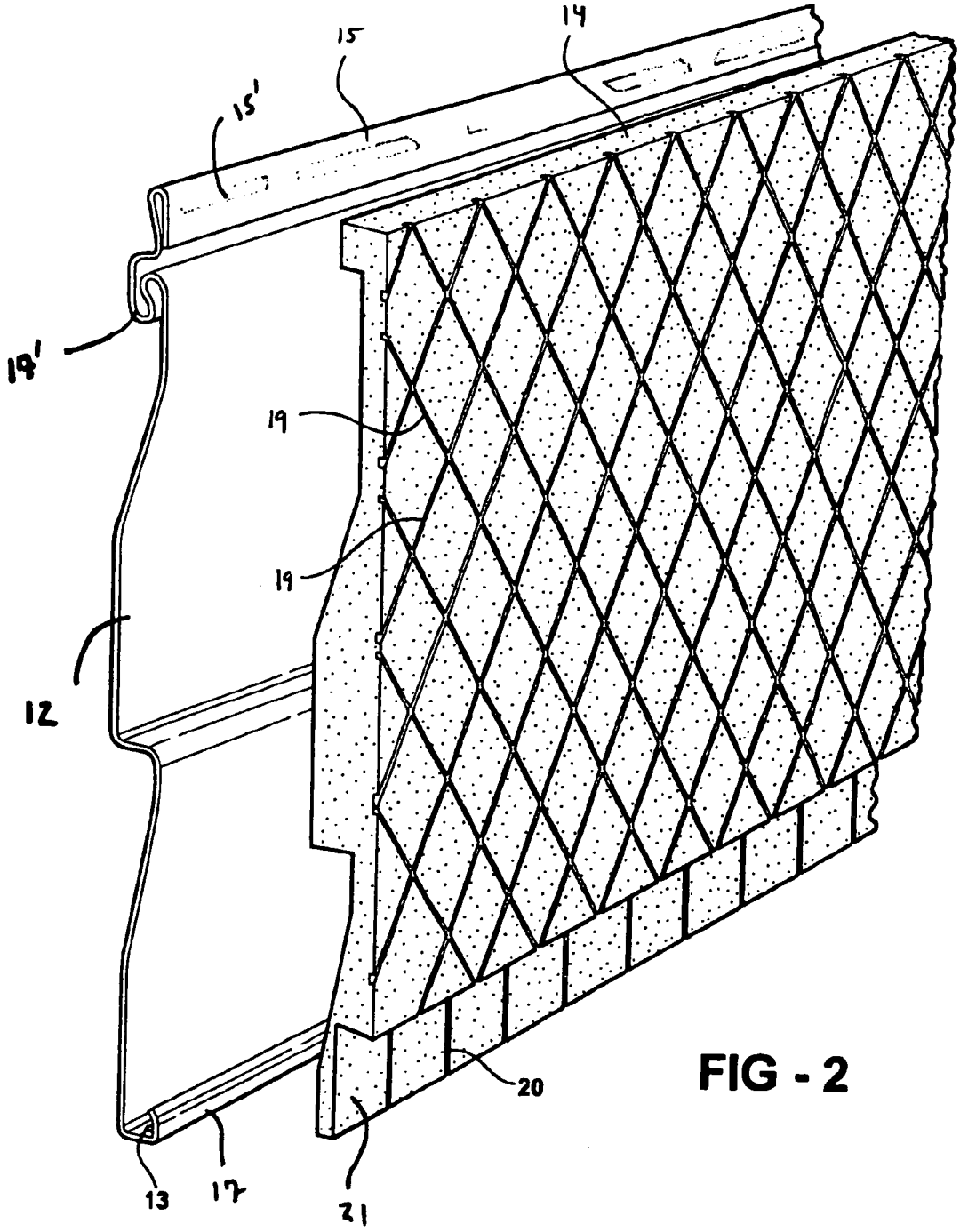
FIG. 2 is a rear exploded perspective view of a panel backing and siding product including the drainage plane of the present invention.
Figure 3C:
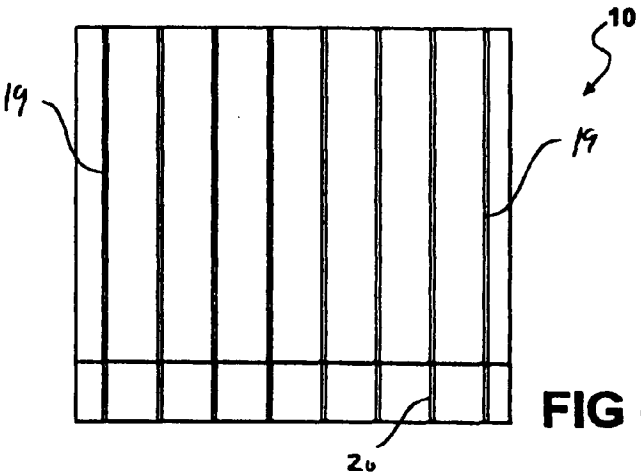
FIG. 3C is a rear plan view of the backing showing the drainage plane arranged in a vertical pattern.
Figure 3D:
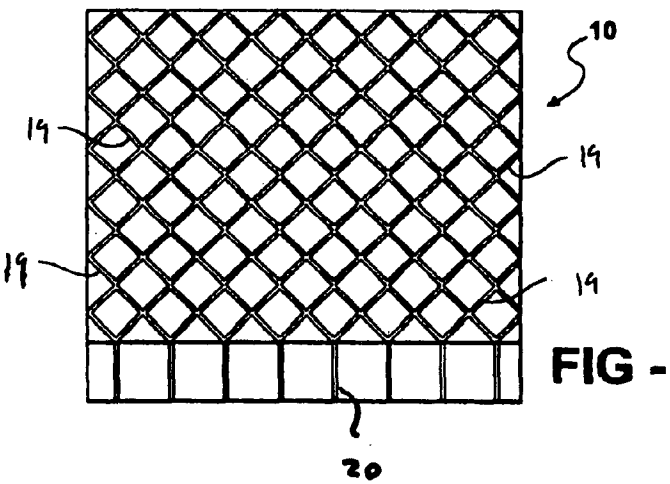
FIG. 3D is a rear plan view of the backing showing the drainage plane arranged in a square pattern.
Figure 3A:
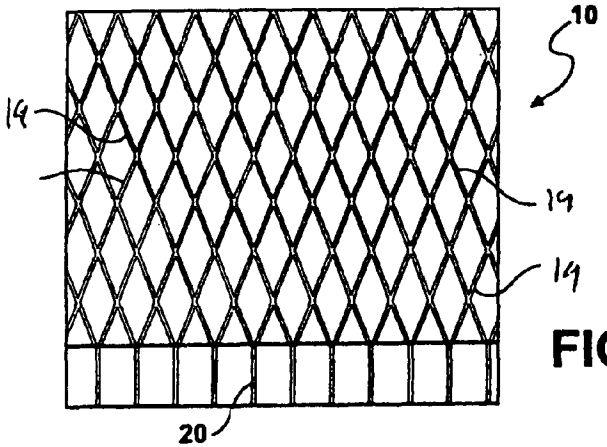
FIG. 3A is a rear plan view of the backing of FIG. 2.
Figure 4:
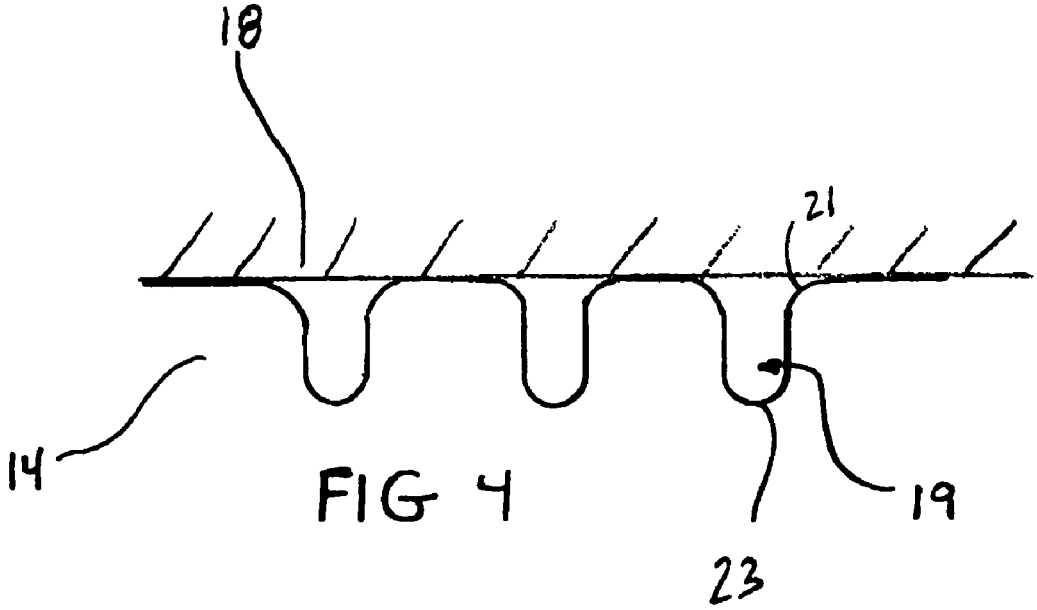
FIG. 4 is a cross sectional view illustrating a preferred groove profile.

With reference to the drawings wherein like items are numbered alike, and with particular reference to FIGS. 1, 2, and 3A, a composite siding product 10 is illustrated. The composite siding product 10 can include a panel backing 14 that can be operably attachable or mountable to a siding component 12. By way of example and not limitation, the siding component 12 can be a contoured siding product 12 and/or the panel backing 14 can be a contoured foam backer. It is understood that the backing 14 can be attached to the siding component 12 in a wide variety of fashions, where attaching and mounting are general terms that can include, by way of example and not limitation, an adhesive, chemical bonding, interlocking complementary surfaces, fasteners, and/or "dropping in" the backing 14 at the job site. As seen in FIG. 4, the rear face of the backing 14 can be positioned parallel to and proximate to an exterior wall 18 of a building. Returning to FIGS. 1, 2, and 3A, the siding component 12 can include a nail strip 15 that can include at least one nail aperture 15', a locking flange 17, and/or a locking lip 17'. The locking flange 17 can be located at a top edge of the siding 12 and the locking lip 17' can be located at a bottom edge of the siding component 12. The locking flange 17 can be configured to operably engage the locking lip 17' of an adjacent contour siding 12. In this way, the composite siding panels 10 can be vertically interlocked in courses up the exterior wall 18 of the building. Installers can drive nails through nail apertures 15' to secure each piece onto the exterior wall 18.

By way of example and not limitation, the backing 14 can be formed of an expanded polystyrene (EPS) foam material, and the siding component 12 can be formed of a vinyl material. By way of example and not limitation, the foam can have a permeability rating of 1.0 or higher. By way of example and not limitation, a suitable adhesively-formed composite siding panel on which the present invention may be advantageously used is manufactured by Progressive Foam Technologies of Beach City, Ohio.

With reference to FIG. 2, the composite siding product 10 is further illustrated. As illustrated in FIG. 2, the rear face of the backing 14 can include a drainage plane made up of a grid network that can include a plurality of drainage grooves 19. As shown in the example of FIG. 2, the drainage grooves 19 can be positioned in a diamond pattern and can be set apart with a spacing of one inch. As water flows through the grid made up of the drainage grooves 19, the water can flow into a plurality of exit grooves 20. The exit grooves 20 can be positioned on a pocketed area 21 of the backing 14. The exit grooves 20 can intersect the drainage grooves 19. The exit grooves 20 can facilitate the water to travel into at least one weep hole 13. After exiting the at least one weep hole 13, the water can be harmlessly directed to the exterior surface of the siding component 12 and ultimately to the ground.

With reference to FIG. 2, the backing 14 is shown just before mounting to the siding component 12. As shown, the backing 14 is mounted so that an overlap end proximate to the top edge of the backing 14 overlaps the nail strip 15. The front face of the pocketed end 21 is mounted flush to the siding component and above the locking flange 17. FIG. 1 shows the hacking 14 and siding component mounted.

As illustrated in FIG. 3A, each set of drainage grooves 19 can be arranged in a diamond pattern at roughly a 30° angle from a vertical orientation. It is understood, that, as will be described below, the grooves can be positioned in a wide variety of angles and in a wide variety of patterns.

Figure 3B:
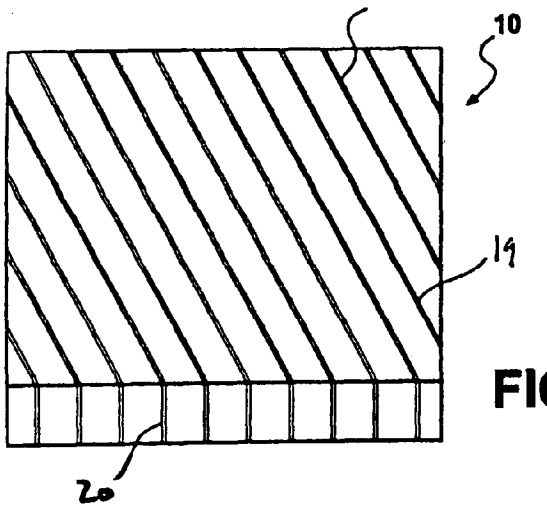
FIG. 3B is a rear plan view of the backing showing the drainage plane arranged in a diagonal pattern.

With reference to FIGS. 3B-3D, there is illustrated a plurality of examples of grid arrangements. These arrangements can include a diagonal pattern as illustrated in FIG. 3B, a vertical pattern as illustrated in FIG. 3C, and/or and a square pattern with the drainage grooves 19 positioned at an angle of 45° from the vertical orientation as illustrated in FIG. 3D.

With reference to FIG. 4, the preferred profile of each drainage groove 19 and each exit groove 20 is illustrated. By way of example and not limitation, each drainage groove 19 and each exit groove 20 can have a depth of approximately 1/16 to 1/8 of an inch, inclusive. In the preferred embodiment, each drainage groove 19 and exit groove 20 can have a tapered or rounded bottom 23 to cause the water to flow with reduced surface tension. Each drainage groove 19 and each exit groove 20 can include a tapered edge 21 to encourage water to flow freely into each groove. As water is drawn into the grid, a syphoning effect will cause water flow to increase.

The drainage plane of the present invention may be formed in a wide variety of ways. By way of example and not limitation, the drainage plane can be formed by molding the drainage grooves 19 and the exit grooves 20 into the rear face of the backing 14, and/or the drainage grooves 19, and the exit grooves 20 can be cut into the rear face of the backing 14 using hot wires or the like.

What is claimed is:

1. A siding panel for mounting on an exterior wall of a building comprising:

a siding component having a top end and a bottom end, the bottom end comprising a locking flange with a plurality of apertures defined therein; and a foam panel backing including a main body portion having a rear face and a front face opposite the rear face mounted on the siding component, a pocketed end, and a top end opposite the pocketed end;

wherein the rear face is mountable on the exterior wall and includes a plurality of drainage grooves over the entire rear face operable to remove water from a surface of the exterior wall;

wherein the pocketed end has a front face contiguous with the front face of the main body portion and a rear face spaced from the rear face of the main body portion to form a step with a bottom edge of the rear face, both the bottom edge of the rear face and the rear face of the pocketed end including a plurality of exit grooves positioned along the pocketed end, the exit grooves each having an origin and a terminus, the origin of each exit groove contiguous and in fluid communication with at least one drainage groove defined in the rear face of the main body portion, the terminus of each exit groove located at a bottom edge of the rear face of the pocketed end and in fluid communication with the plurality of apertures of the locking flange to facilitate the removal of water away from a surface of the exterior wall;

wherein the top end of the foam panel backing has a lip that extends over the top end of the siding component, and wherein the top end of the foam panel backing has a single smooth top surface; and wherein the plurality of drainage grooves comprises a network of grooves positioned in a square grid pattern oriented at an angle of forty-five degrees (45°) from vertical.

2. The siding panel of claim 1, wherein the plurality of grooves are integrally formed into the rear face of the foam panel backing.

3. The siding panel of claim 1, wherein the plurality of grooves are cut into the rear face of the foam panel backing.

4. The siding panel of claim 3, wherein the plurality of grooves are cut into the rear face of the foam panel backing using hot wires.

5. The siding panel of claim 1, wherein the front face is contoured complementary to a rear face of the siding component.

6. The siding panel of claim 1, wherein the plurality of grooves each has a tapered bottom for increased water flow due to reduced surface tension.

7. The siding panel of claim 1, wherein the plurality of grooves each has a rounded bottom for increased water flow due to reduced surface tension.

8. The siding panel of claim 1, wherein the plurality of grooves each has a tapered edge to encourage water to flow freely into the groove.

9. The siding panel of claim 1, wherein the siding component further comprises a nail strip including a plurality of nail apertures for securing the siding to the exterior wall of the building.

10. The siding panel of claim 1, wherein the siding component further comprises:

a locking lip located proximate to the top edge of the siding component, wherein the locking flange is configured to operably engage the locking lip of an adjacent siding panel while maintaining at least a portion of the rear face of the pocketed end in spaced relation to the adjacent siding panel to maintain water removal through the exit grooves to an external area through the apertures.

11. A foam insulation backing mountable on a siding component, the foam insulation backing comprising:

a rear face having a plurality of drainage grooves located across the entire rear face, wherein only a portion of the plurality of drainage grooves contacts a building, the plurality of drainage grooves comprising two patterns, one pattern being a square grid pattern oriented at an angle of forty-five degrees (45°) from vertical, the square grid pattern being the portion of the drainage grooves that contacts the building, wherein the portion of the plurality of drainage grooves not in contact with the building comprise a terminus proximate a bottom edge of the rear face to convey water from the rear face of the foam insulation backing to an area external of the insulation backing through corresponding apertures in a bottom flange of the siding component;

a front face opposite the rear face and contoured to form fit the siding component; and an overlap end opposite the bottom edge and configured to extend beyond a top edge of the siding component, the overlap end having a single smooth top surface.

12. The foam insulation backing of claim 11, wherein the siding component further comprises a locking lip located proximate to the top edge of the siding component, wherein the locking flange is configured to operably engage the locking lip of an adjacent siding panel while maintaining at least a portion of the plurality of drainage grooves not in contact with the building in spaced relation to the adjacent siding panel to maintain water removal through the apertures.

* * * * *

UNITED STATES PATENT AND TRADEMARK OFFICE

CERTIFICATE OF CORRECTION

PATENT NO. : 8,091,313 B2
APPLICATION NO. : 10/965538
DATED : January 10, 2012
INVENTOR(S) : Wilson et al.

It is certified that error appears in the above-identified patent and that said Letters Patent is hereby corrected as shown below:

Title Page, Item (54) and Col. 1, Lines 1 & 2, the title should read:

"DRAINAGE PLANE FOR EXTERIOR WALL PRODUCT".

Signed and Sealed this
Fifth Day of June, 2012

David J. Kappos

David J. Kappos
*Director of the United States Patent and Trademark Office*